US005270549A

United States Patent [19]

Engdahl

[11] Patent Number: 5,270,549

[45] Date of Patent: Dec. 14, 1993

[54] ANNULAR CYLINDRICAL MULTIHOLE COLLIMATOR FOR A RADIOISOTOPE CAMERA AND METHOD OF MAKING SAME

[75] Inventor: Lawrence W. Engdahl, Guilford, Conn.

[73] Assignee: Digital Scintigraphics, Inc., Waltham, Mass.

[21] Appl. No.: 894,249

[22] Filed: Jun. 8, 1992

[51] Int. Cl.[5] ..... G21K 1/02

[52] U.S. Cl. ..... 250/505.1; 250/363.1; 378/147; 378/149

[58] Field of Search ..... 250/505.1, 363.02, 363.10; 378/147, 149

[56] References Cited

U.S. PATENT DOCUMENTS

| | | | |
|---|---|---|---|
| 3,937,969 | 2/1976 | Muehllohner | 378/149 |
| 3,943,366 | 3/1976 | Plato et al. | 378/149 |
| 4,081,687 | 3/1978 | York et al. | 378/149 |
| 4,450,706 | 5/1984 | Engelmohr | 378/149 |

*Primary Examiner*—Paul M. Dzierzynski
*Assistant Examiner*—Kiet T. Nguyen
*Attorney, Agent, or Firm*—Iandiorio & Dingman

[57] ABSTRACT

An annular cylindrical multihole collimator for a radioisotope camera made by forming a plurality of closed annular radio-opaque plates which may be all corrugated plates or may be half corrugated and half flat, each having at least one collimator segment section and junction, and stacking a number of said plates cylindrically, axially on one another, alternately if both flat and corrugated plates are used, to form an annular cylindrical multihole collimator with at least one segment, each plate being bonded to its adjacent plates.

20 Claims, 7 Drawing Sheets

ANNULAR CYLINDRICAL MULTIHOLE COLLIMATOR FOR A RADIOISOTOPE CAMERA AND METHOD OF MAKING SAME

FIELD OF INVENTION

This invention relates to a ring collimator for a gamma ray or radioisotope camera and a method of making it.

BACKGROUND OF INVENTION

A typical gamma ray or scintillation camera such as described in U.S. Pat. Nos. 4,859,852, 4,584,478, 4,095,107, 4,228,515, 4,593,198, 4,782,233, 4,831,261, 4,837,439, and 5,021,667 uses a collimating device which acts as a lens to project onto a position detector a shadow of parallel, converging or diverging gamma rays from a radioisotope tracer in a patient's body. The position detector includes a scintillation crystal coupled to an array of photodetectors and associated position analysis electronics including, for example, a computer. Initially in planar cameras the collimators were made by stacking corrugated sheets alternately inverted to create a multiplicity of collimator holes in the collimation direction generally transverse to the stacking direction. An adhesive such as epoxy is used to attach the layers to each other. The collimator holes may have any desired cross-sectional shape, e.g., square, triangular, hexagonal, round.

With the advent of circular or ring gamma ray cameras the same stacking technique was used, but the stack was made with a cylindrical jigging surface against one face of the collimator stack so that while the corrugated plates continued to be stacked one on top of the other, the two faces of the stack defined a curved cylindrical surface.

Ring cameras normally use three or more arcuate collimator segments per collimating ring to obtain multiple views from which to reconstruct the image tomographically. These collimator rings may have parallel, converging, or diverging collimator holes and the directions of the holes may vary from segment to segment and/or layer to layer in the collimator, i.e., both in the plane of the cylindrical axis and circumferentially. While this construction technique does maintain good alignment of the collimator holes in the plane of the plates, the plates are often misaligned so that the planes of the various plates do not have the same desired parallelism, convergence, or divergence. This causes degradation in image resolution in the transaxial plane of the camera, which is particularly problematic in conventional high-resolution three dimensional cameras. This technique is also quite labor-intensive and expensive to implement because each of the collimator segments is independently fabricated and then must be mutually aligned with the others and assembled. Further, these arcuate segments are easily deformed to depart from their ideal curvature during extensive handling in fabrication of the arcuate segments, shipping, and final assembly of the segments into a cylindrical (annular) ring collimator. An even more important problem is the difficulty in precisely aligning during assembly each of the segments relative to the others in their orientation about and in the plane of the axis. Fabrication of collimator segments by this technique of stacking in the circumferential direction requires a corrugated plate for each hole about the circumference of the collimator ring and this is usually quite a large number. In the general case the collimator is much larger in circumference than in its axial extent.

In another approach the curvature of the segments is achieved by stamping arcuate, often crescent-shaped corrugated sections and stacking them alternately inverted to create the collimator holes running in the direction between the crescent-shaped curved edges. These crescent-shaped plates are stacked in the axial direction, i.e., along the axis of the cylindrical collimator ring, to form a cylindrical arcuate collimator segment. This approach reduces the number of corrugated plates used if the collimator ring employs only a few segments, and thus reduces the labor and time in fabricating a particular collimator ring. This approach also improves the transaxial alignment of the collimator holes because all the corrugations for a segment plate are formed by the same forming operation. But there still remains the problem of misalignment of the plane of the plates with the desired parallelism, divergence or convergence. There also remains the problem of mutual alignment of the collimator segments at assembly so that each segment is precisely aligned relative to the other segments in their orientation about the collimator axis. And these segments too are susceptible to deformation of the curvature during handling in fabrication, shipping and assembly.

SUMMARY OF INVENTION

It is therefore an object of this invention to provide an improved ring collimator for a radioisotope camera and a method of making it, which is simpler, easier, less expensive and less labor-intensive.

It is a further object of this invention to provide such an improved ring collimator for a radioisotope camera and method of making it in which the transaxial alignment of the collimator holes is extremely precise and independent of assembly accuracy.

It is a further object of this invention to provide such an improved ring collimator for a radioisotope camera and method of making it which is much more rugged and resistant to deforming during fabrication, shipping and assembly.

It is a further object of this invention to provide such an improved ring collimator for a radioisotope camera and method of making it in which the alignment of segments to one another about the axis of the collimator ring is fixed and precise, independent of the number of segments employed and independent of whether the orientation of the collimator holes is parallel, divergent or convergent.

It is a further object of this invention to provide such an improved ring collimator for a radioisotope camera and method of making it in which the desired parallelism, divergence and convergence can be more easily maintained from plate to plate in each segment.

It is a further object of this invention to provide such an improved ring collimator for a radioisotope camera and method of making it in which all the segments are simultaneously fabricated and assembled together in a unitary structure.

It is a further object of this invention to provide such an improved ring collimator for a radioisotope camera and method of making it which eliminates a separate step of segment assembly.

This invention results from the realization that a truly simple and effective yet inexpensive and rugged collimator for a radioisotope camera can be achieved by stacking in the axial direction a plurality of corrugated foils or plates made in the form of a closed annular radio-opaque plate which contains all of the segments.

This invention features a method of making an annular cylindrical multi-hole collimator for a radioisotope camera including forming a closed annular radio-opaque plate having a plurality of corrugations extending from the inner to the outer radius of the plate and defining at least one collimator segment section and junction. A plurality of the plates are stacked cylindrically axially on one another with their peaks and valleys aligned to form an annular cylindrical multi-hole collimator with at least one segment, and each plate is bonded to the adjacent plate.

In a preferred embodiment, a radio-opaque filler medium may be applied between the plates at the junctions between segment sections. The stacking may include arranging the plates on one another relative to alignment means. The step of arranging may include aligning indicia on the plates with guide means. The indicia may include at least one hole. Aligning the indicia may include registering a corrugation of a plate with a guide pin parallel to that corrugation. End caps may be secured at each end of the collimator stack.

The invention also features an annular cylindrical multi-hole collimator for a radioisotope camera including a plurality of closed annular radio-opaque plates each having a plurality of corrugations extending from the inner to the outer radius of the plate defining at least one collimator segment section and junction, and means for bonding the plates together with their peaks and valleys aligned to form an annular cylindrical multi-hole collimator with at least one segment.

In a preferred embodiment there is a radio-opaque filler medium disposed in the plates at the junctions between segment sections, and end caps may be used at each end of the collimator stack.

The invention also features a method of making an annular cylindrical multi-hole collimator for a radioisotope camera including the steps of forming a closed annular radio-opaque plate having a plurality of corrugations extending from the inner to the outer radius of the plate defining at least one collimator section and junction, and forming a closed annular flat radio-opaque plate, and stacking cylindrically, axially, alternately a plurality of the flat and corrugated plates on one another to form an annular cylindrical multi-hole collimator with at least one segment, and bonding each of the plates to its adjacent plates.

In a preferred embodiment there may be applied a radio-opaque filler medium between the plates and the junctions between segment sections, the stacking may include arranging the plates on one another relative to the alignment means, and the arranging may include aligning indicia on the plates with the guide means. The indicia may include at least one hole. Aligning the indicia may include registering a corrugation of a plate with a guide pin parallel to that corrugation. End caps may be secured at each end of the collimator stack.

The invention also features an annular cylindrical multi-hole collimator for a radioisotope camera including a plurality of closed annular radio-opaque plates each having a plurality of corrugations extending from the inner to the outer radius of the plate defining at least one collimator segment section and junction. There are a plurality of closed annular flat radio-opaque plates; means for bonding the flat corrugated plates alternately together to form an annular cylindrical multihole collimator with at least one segment. There may be a radio-opaque filler medium between the plates and the junctions between segment sections and there may be end caps mounted at each end of the collimator stack.

BRIEF DESCRIPTION OF THE DRAWINGS

Other objects, features and advantages will occur to those skilled in the art from the following description of a preferred embodiment and the accompanying drawings, in which.

DESCRIPTION OF THE PREFERRED EMBODIMENTS

Figure 1:
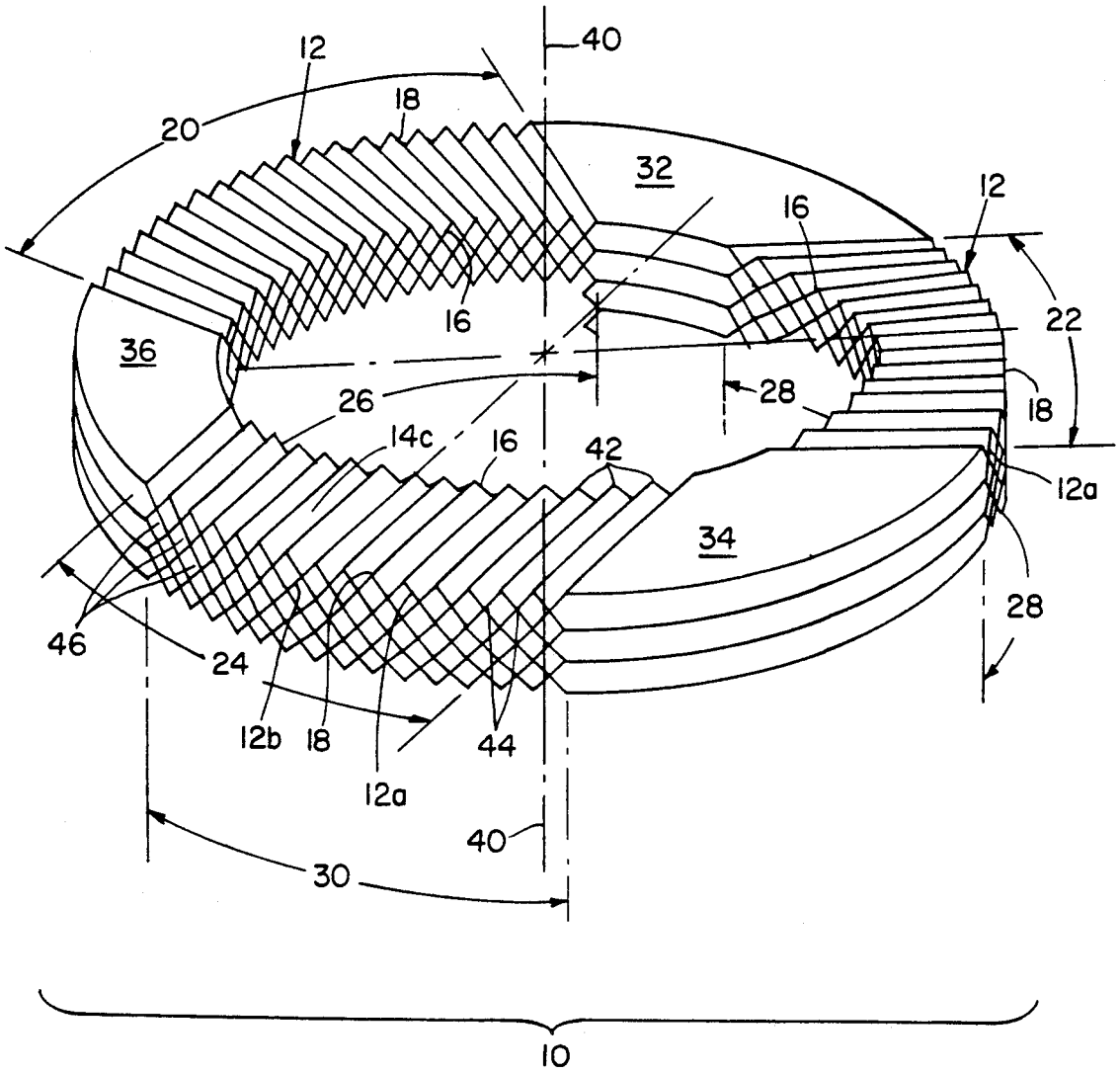
FIG. 1 is a three-dimensional view of an annular cylindrical multihole collimator for a radioisotope camera according to this invention.
Figure 2:
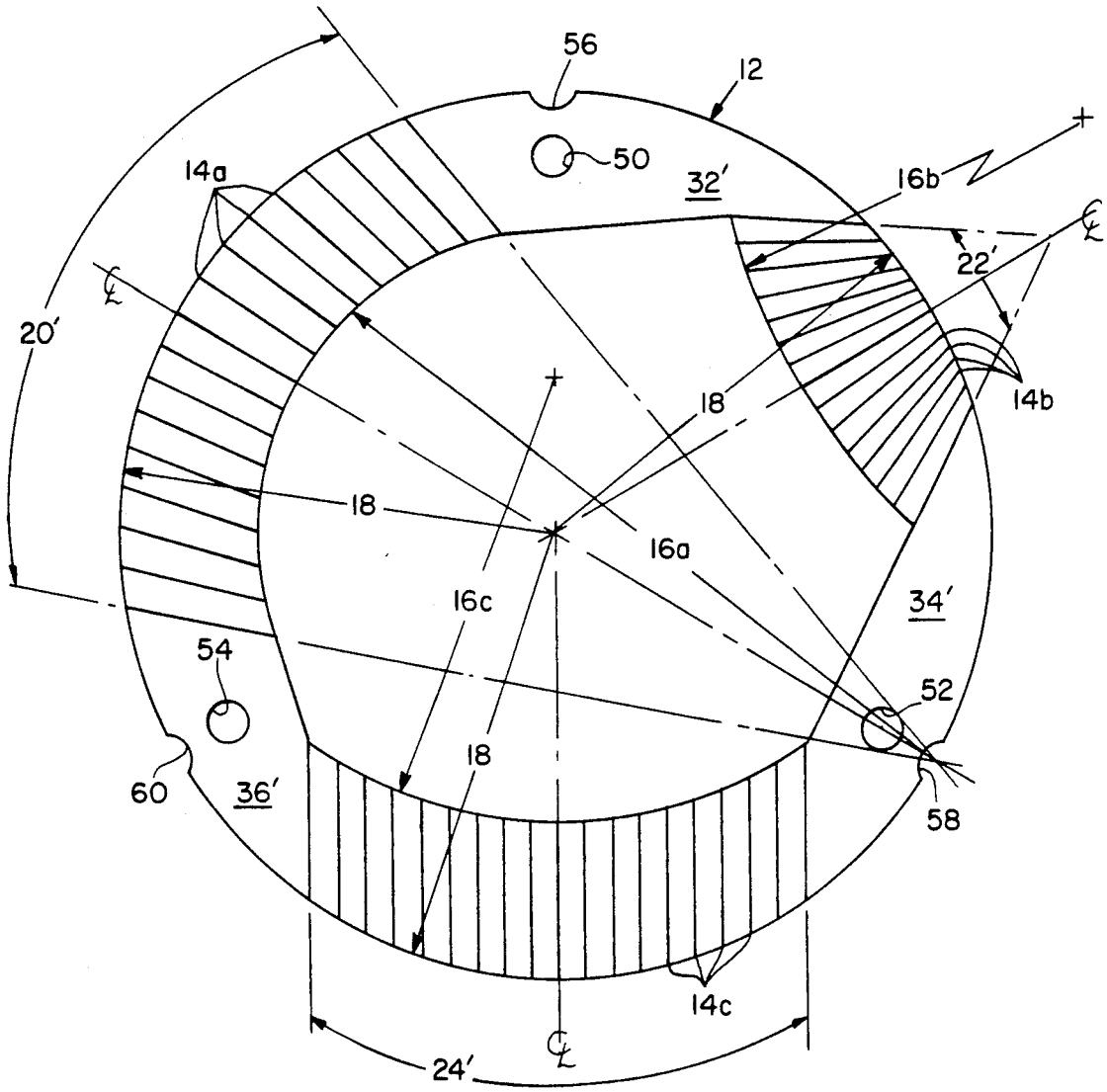
FIG. 2 is a plan view of a single closed annular radio-opaque plate used in the collimator of FIG. 1.

There is shown in FIG. 1 an annular cylindrical multihole collimator 10 for a radioisotope camera. Collimator 10 is made up of a plurality of closed annular radio-opaque plates 12 and 12*a* each having a plurality of corrugations extending from the inner 16 to the outer 18 radius of the plate and defining one or more (actually three in FIG. 1) segment sections 20, 22 and 24, which combine to form three segments 26, 28 and 30 separated by junctions 32, 34 and 36. The junctions are uncorrugated areas between segment sections. If the collimator is to have but one segment then each plate will have but one corrugated segment section and the remainder of the plate will be all junction. The stacking of plates 12 and 12*a* along longitudinal axis 40, with their peaks 42 and valleys 44 aligned from plate to plate, create a multiplicity of holes 46. Each plate 12 or 12*a*, FIG. 2, may have the corrugations 14 converging as shown at 14*a*, diverging as shown at 14*b*, or parallel as shown at 14*c*. Segment sections 20', 22' and 24' may be crescent-shaped as shown in FIG. 2, or may have uniform inner and outer radii as shown in FIG. 1. Aligning means or indicia may be provided for assembly of plates 12 and 12*a*. For example, junctions 32', 34' and 36' may include alignment holes 50, 52, 54, respectively, for receiving alignment pins, or may include notches 56, 58, 60, or some other indicia to meet with a jig or guiding surface. If there is symmetry about a diametral axis through the center of one segment section, then plate 12 can be reversed and used in place of 12*a*.

Figure 3:
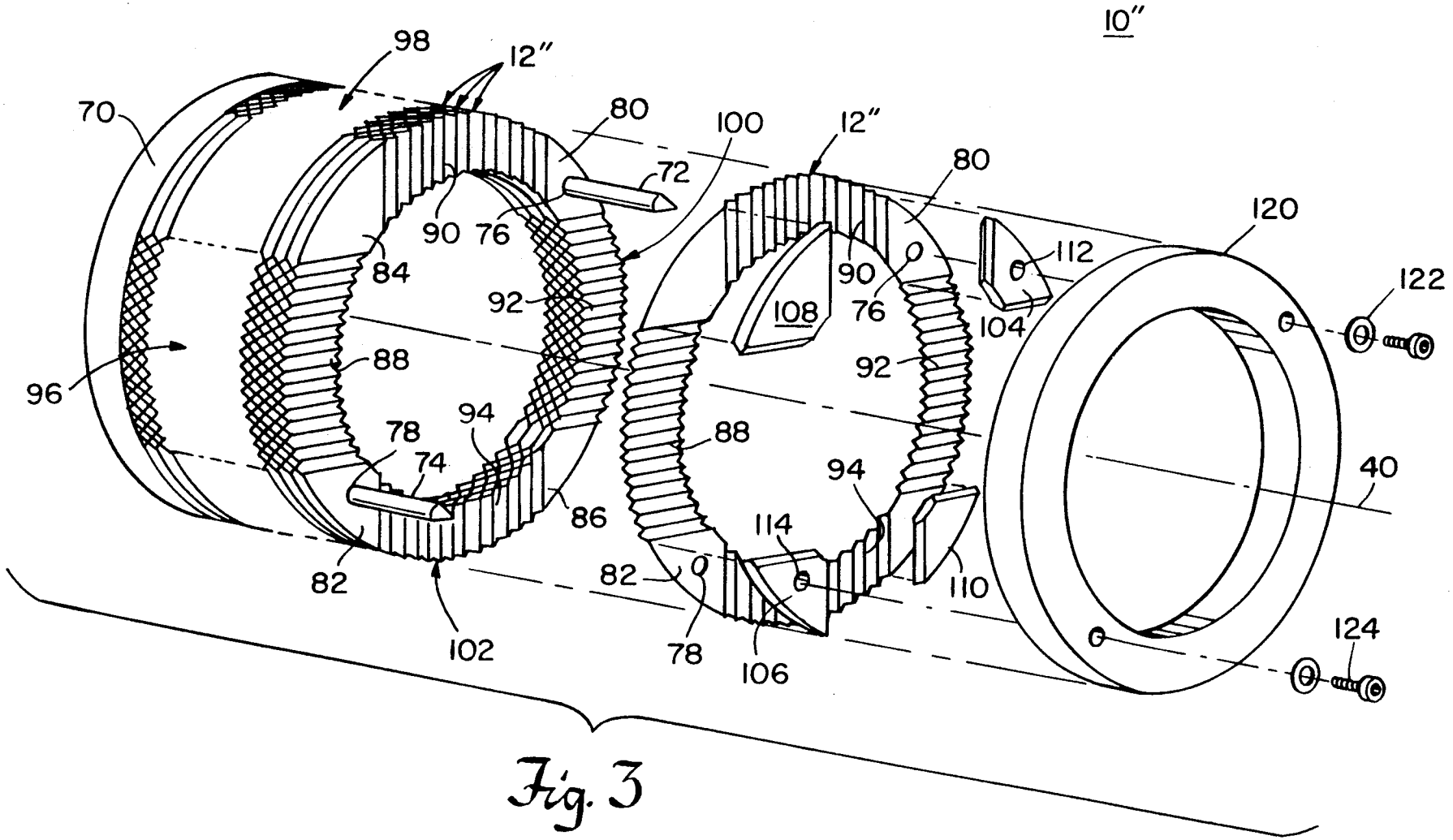
FIG. 3 is an exploded view of an annular cylindrical multihole collimator for a radioisotope camera.

The assembly technique is shown in more detail in FIG. 3, where plates 12*a, b*, . . . , are stacked on a base ring 70 which contains alignment pins 72, 74 which are received in alignment holes 76, 78 in two of the four junctions 80, 82, 84, 86, which define the four segment sections 88, 90, 92, 94 that constitute the four segments 96, 98, 100 and 102. Between the junctions 84 of each plate 12'' are fillers 104, 106, 108 and 110, which are radiologically opaque as are the junctions. Fillers 104 and 106 include holes 112 and 114 respectively, which receive guide pins 72 and 78 receivable in junctions 80 and 82. Cap ring 120 is fastened to alignment pins 72 and 74 by means of screws and washers 122 and 124, thereby unifying the entire assembly.

Figure 4:
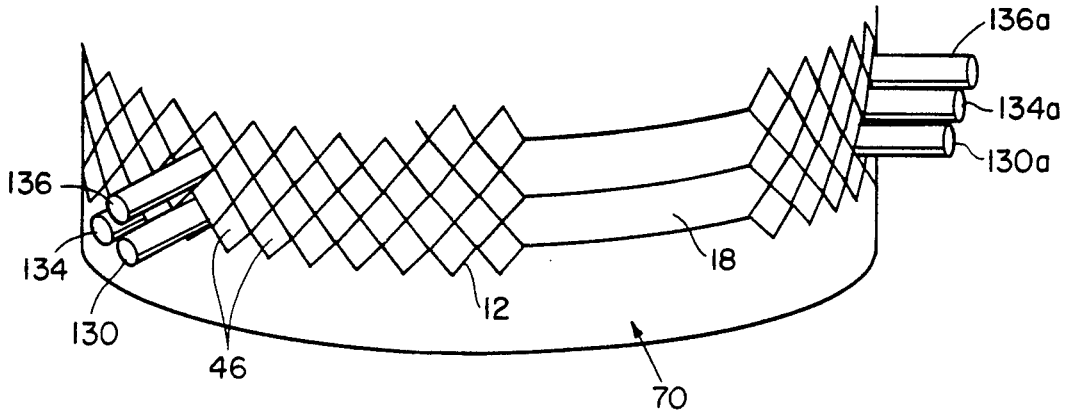
FIG. 4 shows two methods for aligning a stack of annular radio-opaque plates.
Figure 5:
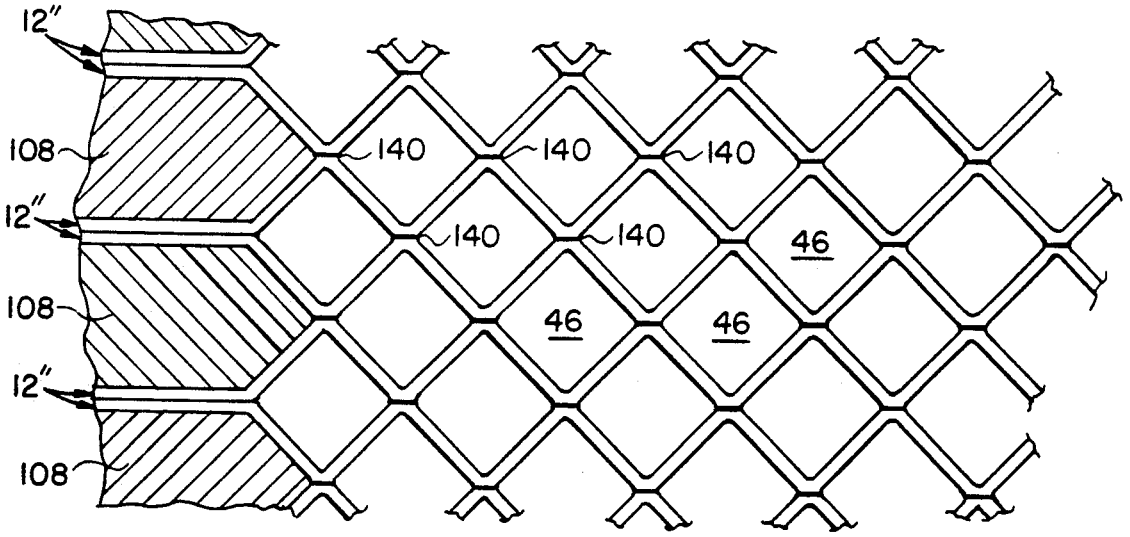
FIG. 5 is a schematic diagram of square hole structure used in an annular cylindrical multihole collimator for a radioisotope camera.
Figure 6:
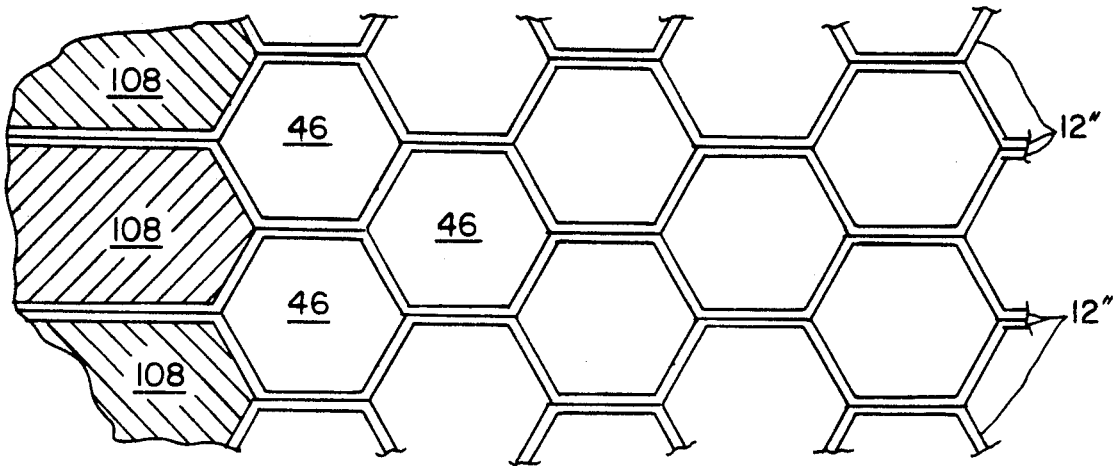
FIG. 6 is a schematic diagram of hexagonal hole structure used in an annular cylindrical multihole collimator for a radioisotope camera.

Optionally, as shown in FIG. 4, assembly can be guided by means of pins which are parallel and provisionally reside in the corrugation holes 46 themselves, FIG. 4. Such pins 130, 134, 136 are shown radially disposed in each layer of holes 46. Preferably at least one additional set of guide pins 130*a*, 134*a*, 136*a*, is provided in order to provide two-dimensional alignment through the quadrature relationship of the pins. Plates 12 and 12*a* are bonded together by a suitable adhesive 140, FIG. 5, where their peaks and valleys contact. Pins 130, 134, 136, 130*a*, 134*a*, 136*a* are removed after bonding is complete. The corrugations may be triangular as shown in FIG. 5 to form square collimator holes 46, or the corrugations may be three-sided to form hexagonal holes as shown in FIG. 6.

Figure 8:
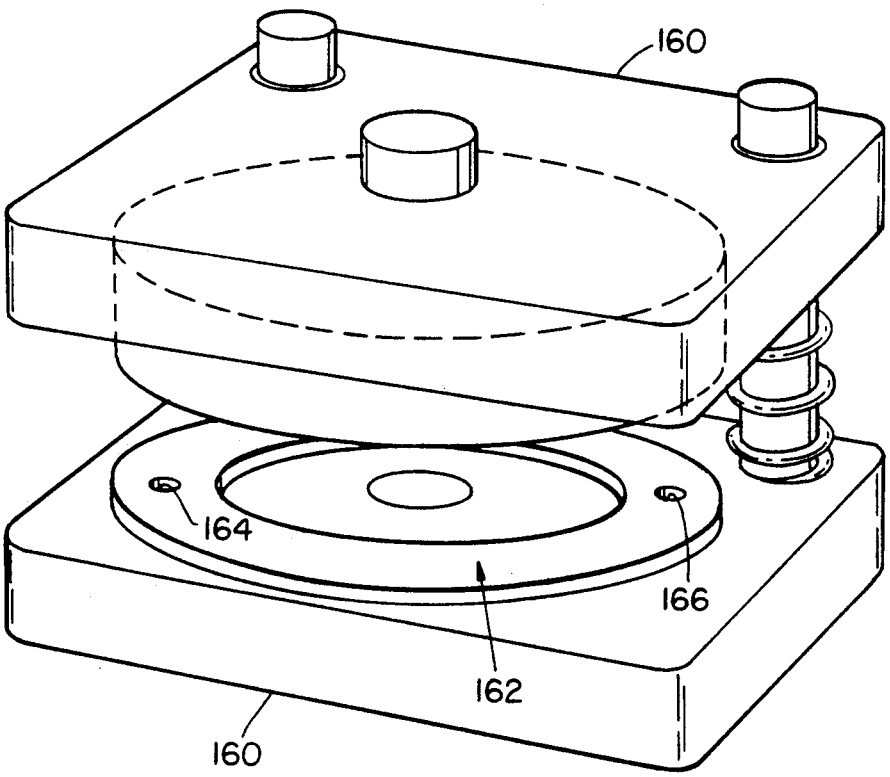
FIG. 8 shows a die set for cutting annular blanks to make plates for the collimator in a radioisotope camera.
Figure 7:
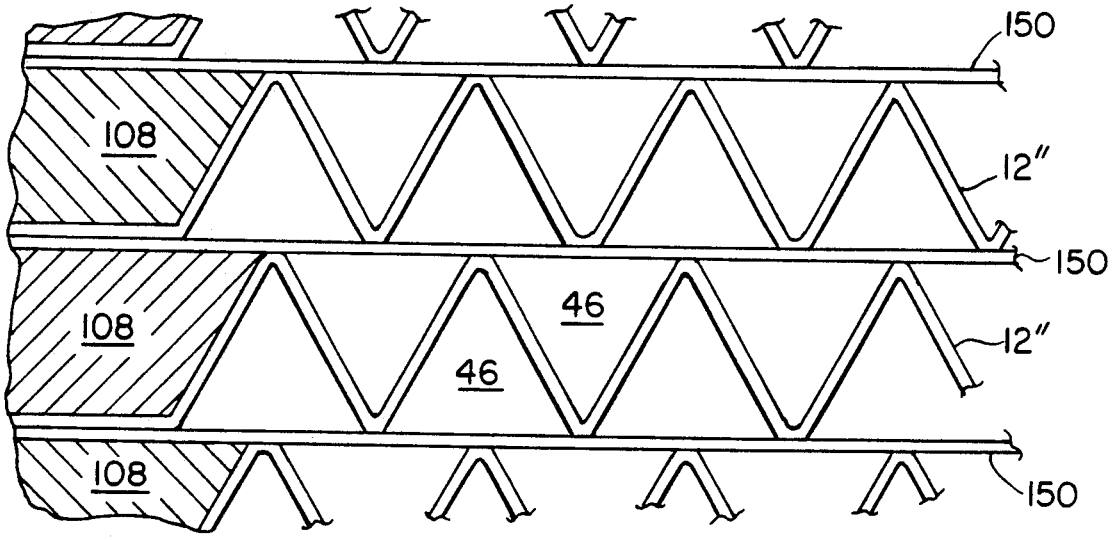
FIG. 7 is a schematic diagram of a triangular hole structure used in an annular cylindrical multihole collimator for a radioisotope camera.
Figure 9:
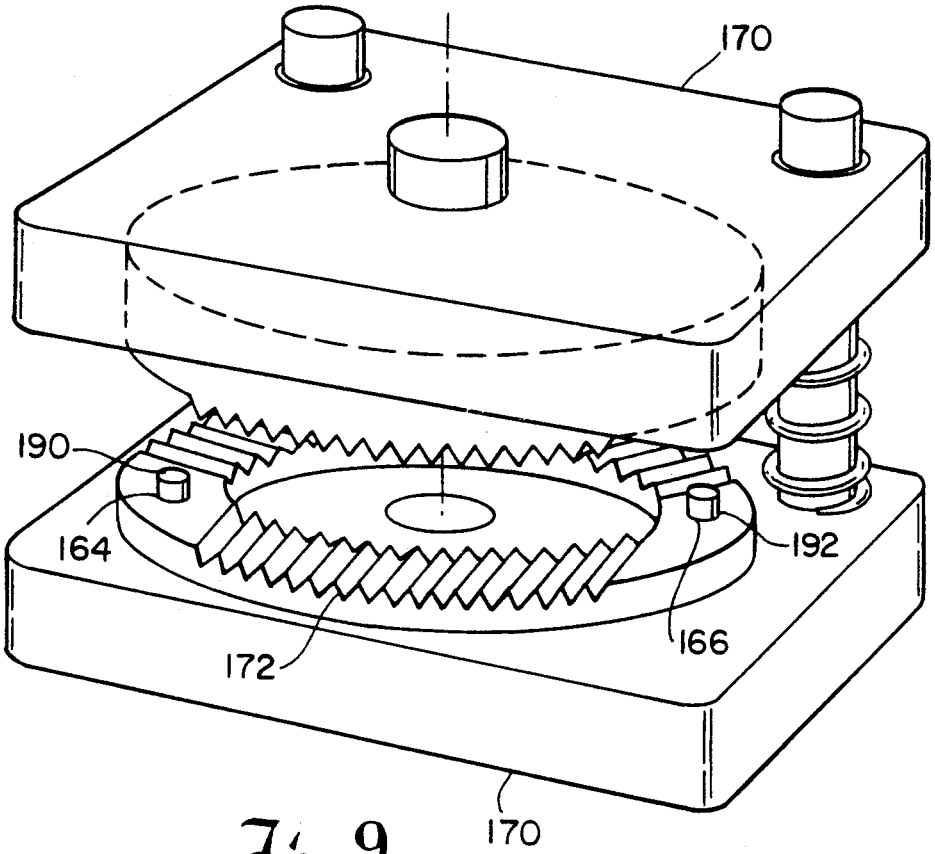
FIG. 9 shows a die set for stamping corrugations in plates used to make a collimator for a radioisotope camera.
Figure 10:
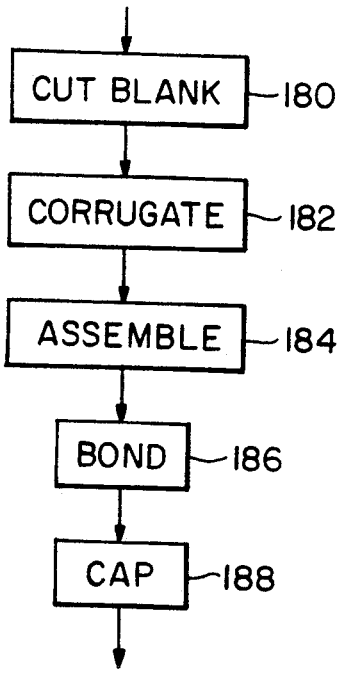
FIG. 10 shows the steps employable in one implementation of the method according to this invention.

Alternatively, triangular corrugations may be used, as shown in FIG. 7, in staggered fashion with joiner plates 150 between them which are bonded to their peaks and valleys. Each plate 12 may be formed from a blank using a press and die set 160, FIG. 8, which cuts an annular blank 162 with two or more guide holes 164 and 166. Blank 162 is then placed in a corrugation die set 170 aligned by pins 190, 192 inserted in holes 160, 164, FIG. 9, to produce a finished corrugated piece 172. The method thus involves the first step 180, FIG. 10, of cutting the blank, followed by the corrugation step 182, after which the finished plates are assembled 184 as shown in FIG. 3 and bonded together, step 186, before they are finally capped 188, again as shown in FIG. 3. In accordance with the structure of FIG. 7, every other plate would be left uncorrugated: that is, step 182, depicted in FIG. 9, would be omitted and the flat blank plate 162 resulting from the operation in FIG. 8 would be used between the corrugated plates.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A method of making an annular cylindrical multihole collimator for a radioisotope camera, comprising:

forming a closed annular radio-opaque plate having a plurality of corrugations extending from the inner to the outer radius of the plate defining at least one collimator segment section and junction;

stacking cylindrically, axially, a plurality of said plates on one another with their peaks and valleys aligned to form an annular cylindrical multihole collimator with at least one segment; and bonding each said plate to its adjacent plates.

2. The method of making an annular cylindrical multihole collimator for a radioisotope camera of claim 1, further including applying a radio-opaque filler medium between said plates at the junction between segment sections.

3. The method of making an annular cylindrical multihole collimator for a radioisotope camera of claim 1 in which stacking includes arranging said plates on one another relative to alignment means.

4. The method of making an annular cylindrical multihole collimator for a radioisotope camera of claim 3 in which arranging includes aligning indicia on the plates with guide means.

5. The method of making an annular cylindrical multihole collimator for a radioisotope camera of claim 4 in which said indicia includes at least one hole.

6. The method of making an annular cylindrical multihole collimator for a radioisotope camera of claim 4 in which aligning said indicia includes registering a corrugation of a plate with a guide pin parallel to that corrugation.

7. The method of making an annular cylindrical multihole collimator for a radioisotope camera of claim 1 further including securing an end cap at each end of said collimator.

8. An annular cylindrical multihole collimator for a radioisotope camera, comprising:

a plurality of closed annular radio-opaque plates each having a plurality of corrugations extending from the inner to the outer radius of the plate defining at least one collimator segment section and junction; and means for bonding said plates together with their peaks and valleys aligned to form an annular cylindrical multihole collimator with at least one segment.

9. The annular cylindrical multihole collimator of claim 8 further including a radio-opaque filler medium disposed between said plates at the junctions between segment sections.

10. The annular cylindrical multihole collimator of claim 8 further including an end cap mounted at each end of said collimator.

11. A method of making an annular cylindrical multihole collimator for a radioisotope camera, comprising:

forming a closed annular radio-opaque plate having a plurality of corrugations extending from the inner to the outer radius of the plate defining at least one collimator segment section and junction;

forming a closed annular flat radio-opaque plate;

stacking cylindrically, axially, alternately a plurality of said flat and corrugated plates on one another to form an annular cylindrical multihole collimator with at least one segment; and bonding each said plate to its adjacent plates.

12. The method of making an annular cylindrical multihole collimator for a radioisotope camera of claim 11, further including applying a radio-opaque filler medium between said plates at the junction between segment sections.

13. The method of making an annular cylindrical multihole collimator for a radioisotope camera of claim 11 in which stacking includes arranging said plates on one another relative to alignment means.

14. The method of making an annular cylindrical multihole collimator for a radioisotope camera of claim 13 in which arranging includes aligning indicia on the plates with guide means.

15. The method of making an annular cylindrical multihole collimator for a radioisotope camera of claim 14 in which said indicia includes at least one hole.

16. The method of making an annular cylindrical multihole collimator for a radioisotope camera of claim 14 in which aligning said indicia includes registering a corrugation of a plate with a guide pin parallel to that corrugation.

17. The method of making an annular cylindrical multihole collimator for a radioisotope camera of claim 11 further including securing an end cap at each end of said collimator.

18. An annular cylindrical multihole collimator for a radioisotope camera, comprising:

a plurality of closed annular radio-opaque plates each having a plurality of corrugations extending from the inner to the outer radius of the plate defining at least one collimator segment section and junction;

a plurality of closed, annular, flat radio-opaque plates; and means for bonding said flat and corrugated plates alternately together to form an annular cylindrical multihole collimator with at least one segment.

19. The annular cylindrical multihole collimator for a radioisotope camera of claim 18 further including a radio-opaque filler medium disposed between said plates at the junctions between segment sections.

20. The annular cylindrical multihole collimator for a radioisotope camera of claim 18 further including an end cap mounted at each end of said collimator.

* * * * *